US006298515B1

(12) United States Patent
Robinson

(10) Patent No.: US 6,298,515 B1
(45) Date of Patent: Oct. 9, 2001

(54) MULTI-PURPOSE SCRUBBING SPONGE

(76) Inventor: Bessie Jane Robinson, 440 S. 14th Ave., Yuma, AZ (US) 85364

( * ) Notice: Subject to any disclaimer, the term of this patent is extended or adjusted under 35 U.S.C. 154(b) by 0 days.

(21) Appl. No.: 09/522,347

(22) Filed: Mar. 9, 2000

(51) Int. Cl.[7] ..... A47L 17/00
(52) U.S. Cl. ..... 15/114; 15/164; 15/211
(58) Field of Search ..... 15/114, 164, 211

(56) References Cited

U.S. PATENT DOCUMENTS

| | | | | |
|---|---|---|---|---|
| 1,936,259 | * | 11/1933 | Parmer | 15/211 |
| 2,270,744 | * | 1/1942 | Singer | 15/211 X |
| 2,561,240 | * | 7/1951 | Spearman | 15/164 |
| 3,135,003 | * | 6/1964 | Wise | 15/211 X |
| 3,914,165 | * | 10/1975 | Behnk | 15/211 X |
| 3,934,300 | * | 1/1976 | Tortorello | 15/211 X |
| 4,502,176 | | 3/1985 | Wallace | 15/164 |
| 4,811,448 | * | 3/1989 | Yagi | 15/211 |
| 5,488,747 | | 2/1996 | Woodhouse | 15/23 |
| 5,608,938 | | 3/1997 | Baschenis | 15/68 |
| 5,709,003 | | 1/1998 | Batch | 15/106 |
| 5,775,827 | | 7/1998 | Packham et al. | 401/129 |

* cited by examiner

*Primary Examiner*—Mark Spisich
(74) *Attorney, Agent, or Firm*—Randal D. Homburg

(57) ABSTRACT

The invention is a multi-purpose scrubbing sponge having a central rigid rod with a brush on one end, a widened base on the other, the rod surrounded by compressible foam and covered in a mild abrasive flexible mesh and a scrubbing mesh skirt, such compressible foam conforming to the interior of a glass or other hollow container, the brush and mesh assisting in removal of debris from the interior of such glass or hollow container.

4 Claims, 2 Drawing Sheets

MULTI-PURPOSE SCRUBBING SPONGE

CROSS REFERENCE TO RELATED APPLICATIONS

None.

I. BACKGROUND OF THE INVENTION

1. Field of the Invention

The invention is a multi-purpose scrubbing sponge having a central rigid rod with a brush on one end, a widened base on the other, the rod surrounded by compressible foam and covered in a mild abrasive flexible mesh and a scrubbing mesh skirt, such compressible foam conforming to the interior of a glass or other hollow container, the brush and mesh assisting in removal of debris from the interior of such glass or hollow container.

2. Description of Prior Art

The following United States patents are disclosed herein and incorporated into this application for utility patent. All relate to bottle brushes and scrubbing pads. In U.S. Pat. No. 4,502,176 to Wallace, a bottle brush mounted to the side of a sink or to a flat surface is disclosed. Another bottle brush having a flexible rod which can be mounted to a hand-held food mixer is disclosed in U.S. Pat. No. 5,488,747 to Woodhouse.

U.S. Pat. No. 5,608,938 to Baschenis discloses a bottle brush assembly having a cap with a bottle brush built within to be attached to a bottle and by raising and lowering the stem, a rotating and scrubbing action is performed on the brush attached to the stem within the bottle being washed. Similarly, a crank arm cleaning brush with a scrub pad is disclosed in U.S. Pat. No. 5,709,003 to Batch, which also has a cap affixed to the bottle. However, in the Batch Patent, the user turns the crank in a circle to cause the brush inside to rotate. A self-cleaning brush having a stem with a brush on one end and a cap on the other end, also incorporating a self cleaning means for the stem to remove dried fluids, is disclosed in U.S. Pat. No. 5,775,827 to Packham, et al.

II. SUMMARY OF THE INVENTION

The primary objective of the invention is to provide a multi-purpose dishwashing cleaning device, specifically for use with glasses, cups or hollow interior dishes and containers, having multiple scrubbing properties and surfaces. A secondary objective of the invention is to provide a shape-conforming scrub device which retains wash liquid and dispenses the wash liquid during the scrubbing process. A third objective of the invention is to provide a scrubbing device with form conforming properties for use with multiple shape and size glasses, bottle and the like.

III. DESCRIPTION OF THE DRAWINGS

The following drawings are submitted with this utility patent application.

IV. DESCRIPTION OF THE PREFERRED EMBODIMENT

Figure 1:
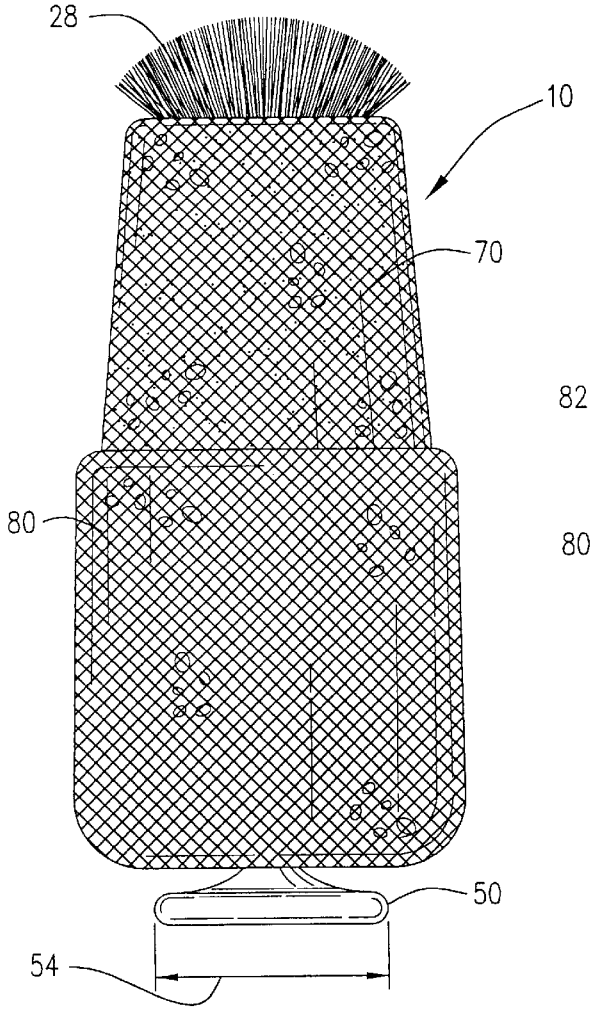
FIG. 1 is a side view of the invention.

The invention, as shown in FIGS. 1–4 of the drawings, is a multiple purpose scrubbing sponge 10 comprising a central support rod 20, a contoured dense foam cylinder 60, a bristle brush 28, a scrubbing mesh cover 70, and a padded mesh apron 80, used to clean the inside and the outside of a glass 100, bottle or other hollow item to be washed.

The central support rod 20 is a rigid plastic rod having a cylindrical brush base end 22, a cylindrical shaft 40, and a cylindrical flared stand end 50. The cylindrical brush base end 22 is a flattened cylindrical disk having a top surface 24, a bottom surface 30 and a circumference, the bottom surface 30 having a central point 34 which is attached to a first end 42 of the cylindrical shaft 40, the cylindrical shaft 40 also having a circumference 46. The circumference of the cylindrical brush base end 22 is substantially greater than the circumference 46 of the cylindrical shaft 40. The top surface 24 of the brush base end 22 has a multiplicity of projecting firm bristles 26, the totality of the projecting firm bristles 26 forming a circular contoured bristle brush 28.

The cylindrical flared stand end 50 has an upper surface 52, a circumference 54 and a flattened bottom surface 56, the upper surface 52 connected to a second end 44 of the cylindrical shaft 40. The circumference 54 of the cylindrical flared stand end 50 is substantially greater than the circumference 46 of the cylindrical shaft 40.

Figure 2:
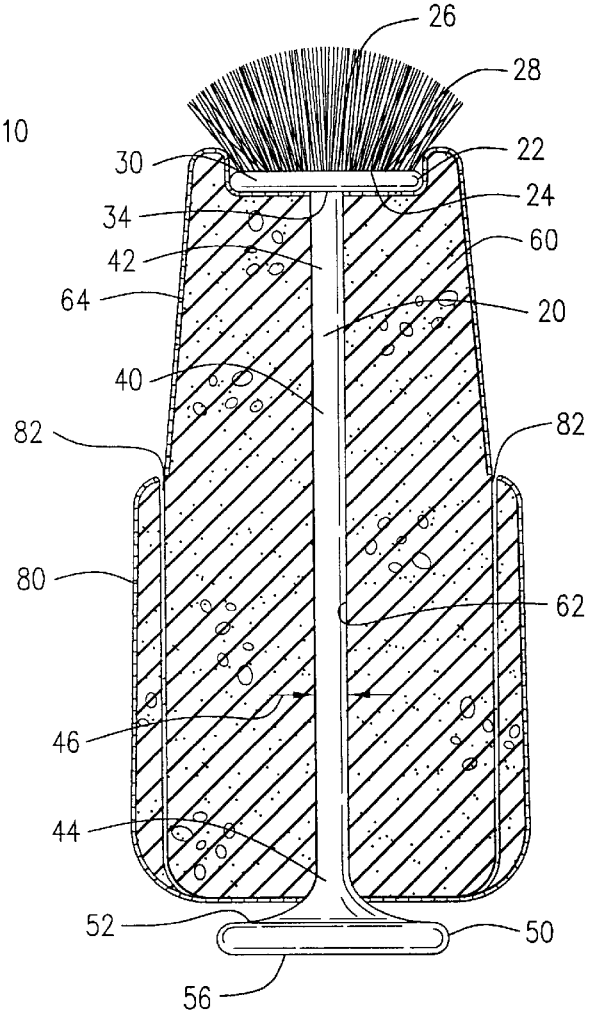
FIG. 2 is a cross-sectional side view of the invention.
Figure 3:
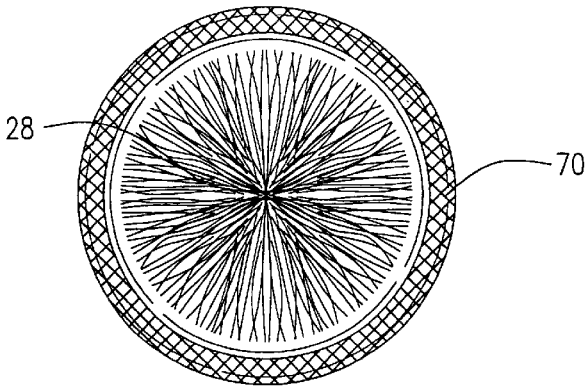
FIG. 3 is a top view of the invention.
Figure 4:
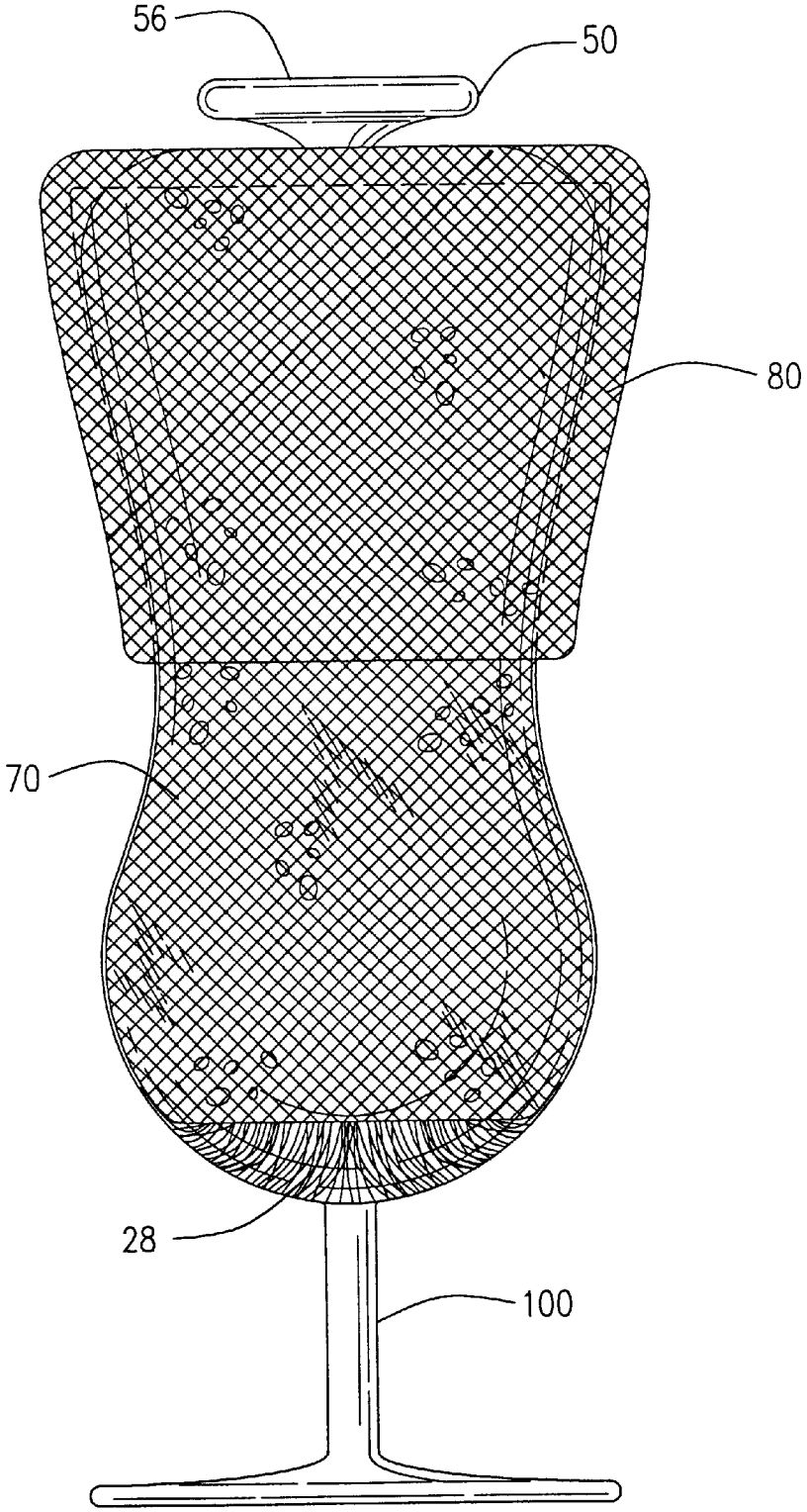
FIG. 4 is the invention inserted within a bottle.

Surrounding the entire cylindrical shaft 40 of the central support rod 20 is a contoured foam sponge cylinder 60 having a longitudinal bore 62, as shown in FIG. 2 of the drawings, through which the cylindrical shaft 40 penetrates. The contoured foam sponge cylinder 60 has an outer surface 64, which is completely covered by an attached scrubbing mesh skirt 70, most preferably made of a nylon mesh. The contoured foam sponge cylinder 60 and the scrubbing mesh skirt 70 are deformable to conform to the inner shape of the bottle, glass or other container 100 into which they are inserted.

A padded mesh apron 80 also extends from the cylindrical flared stand end 50, on top of the scrubbing mesh skirt 70 surrounding the contoured foam sponge cylinder 60, thus forming a pocket 82 between the padded mesh apron 80 and the scrubbing mesh skirt 70, wherein the rim of the bottle, glass or other container 100 being scrubbed fits within said pocket 82 for washing the outside of the bottle, glass or other container 100 at the same time the inside of the bottle, glass or other container 100 is being washed.

The invention therefore provides four scrubbing surfaces, which include the bristle brush 28, the contoured foam sponge cylinder 60, the scrubbing mesh skirt 70, and the pocket 82 between the padded mesh apron 80 and the scrubbing mesh skirt 70. The contoured foam sponge cylinder 60, being deformable, when inserted within the bottle, glass or other container 100, will conform to the inner shape of such glass or bottle providing a form-fitting multiple scrubbing surface with the capability of contacting all inner surfaces of glasses, bottles or other containers 100 to be washed. The padded mesh apron 80, at the same time, will conform to the outside of the glass, bottle or other container 100 being washed.

While the invention has been particularly shown and described with reference to a preferred embodiment thereof, it will be understood by those skilled in the art that changes in form and detail may be made therein without departing from the spirit and scope of the invention.

What is claimed is:

1. A multiple purpose scrubbing sponge comprising:

a. a central support rod, having a cylindrical brush base end with an attached bristle brush, a cylindrical shaft and a cylindrical flared stand end;

b. a contoured foam sponge cylinder having a central bore surrounding the cylindrical shaft and having an outer surface;

c. a scrubbing mesh skirt covering the outer surface of the contoured foam sponge cylinder; and d. a padded mesh apron, extending from the cylindrical flared stand end, on top of the scrubbing mesh skirt, a pocket being formed between said padded mesh apron and said scrubbing mesh skirt.

2. The invention, as disclosed in claim 1, the central support rod further comprising:

a. the cylindrical brush base end is a flattened cylindrical disk having a top surface, a bottom surface and a circumference;

b. the cylindrical shaft having a circumference;

c. the cylindrical flared stand end having an upper surface, a circumference and a flattened bottom;

d. the top surface of the cylindrical brush base end having a multiplicity of projecting firm bristles, the totality of the projecting firm bristles forming a circular contoured bristle brush; and e. the circumference of the cylindrical brush base end and the cylindrical flared stand end are substantially greater than the circumference of the cylindrical shaft.

3. The invention, as disclosed in claim 1, further comprising:

the scrubbing mesh skirt and the padded mesh apron are a nylon mesh.

4. A multiple purpose scrubbing sponge comprising:

a. a central support rod, having a cylindrical brush base end with an attached bristle brush, a cylindrical shaft and a cylindrical flared stand end, wherein the cylindrical brush base end is a flattened cylindrical disk having a top surface, a bottom surface and a circumference, the cylindrical shaft has a circumference, the cylindrical flared stand end has an upper surface, a circumference and a flattened bottom, the top surface of the cylindrical brush base end having a multiplicity of projecting firm bristles, the totality of the projecting firm bristles forming a circular contoured bristle brush and the circumference of the cylindrical brush base end and the cylindrical flared stand end are substantially greater than the circumference of the cylindrical shaft;

b. a contoured foam sponge cylinder having a central bore surrounding the cylindrical shaft and having an outer surface;

c. a nylon scrubbing mesh skirt partially covering the outer surface of the contoured foam sponge cylinder; and d. a nylon padded mesh apron, extending from the cylindrical flared stand end, on top of the scrubbing mesh skirt, a pocket being formed between said padded mesh apron and said scrubbing mesh skirt.

* * * * *